US006161620A

United States Patent [19]

Cox et al.

[11] Patent Number: 6,161,620

[45] **Date of Patent: *Dec. 19, 2000**

[54] DEEPWATER RISER SYSTEM

[75] Inventors: Bobby Eugene Cox, Kenner, La.; Stephen W. Balint; Anders G. C. Ekvall, both of Houston, Tex.

[73] Assignee: Shell Oil Company, Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/997,631

[22] Filed: Dec. 23, 1997

Related U.S. Application Data

[60] Provisional application No. 60/034,465, Dec. 31, 1996.

[51] Int. Cl.[7] ..... E21B 17/01; E21B 7/12

[52] U.S. Cl. ..... 166/367; 166/359; 405/195.1; 405/224

[58] Field of Search ..... 405/195.1, 224, 405/224.1, 223.1, 204, 205; 166/350, 359, 367, 355

[56] References Cited

U.S. PATENT DOCUMENTS

| | | | |
|---|---|---|---|
| 3,017,934 | 1/1962 | Rhodes . | |
| 3,426,858 | 2/1969 | Bauer . | |
| 3,858,401 | 1/1975 | Watkins . | |
| 3,952,526 | 4/1976 | Watkins et al. | 405/224 |
| 3,981,357 | 9/1976 | Walker et al. . | |
| 3,992,889 | 11/1976 | Watkins et al. . | |
| 4,185,694 | 1/1980 | Horton | 166/350 |
| 4,198,179 | 4/1980 | Pease et al. | 405/195 |
| 4,216,834 | 8/1980 | Wardlaw | 175/7 |
| 4,297,965 | 11/1981 | Horton et al. | 114/265 |
| 4,436,451 | 3/1984 | Anderson | 405/195 |
| 4,448,266 | 5/1984 | Potts | 175/7 |
| 4,473,323 | 9/1984 | Gregory | 405/224 |
| 4,626,136 | 12/1986 | Gunderson | 405/224 |
| 4,630,970 | 12/1986 | Gunderson et al. | 405/224 |
| 4,636,114 | 1/1987 | Hale | 405/224 |
| 4,646,840 | 3/1987 | Bartholomew et al. | 405/195.1 X |
| 4,648,747 | 3/1987 | Watkins et al. | 405/195.1 |
| 4,656,962 | 4/1987 | Hale | 114/264 |
| 4,657,439 | 4/1987 | Petersen | 166/350 X |
| 4,702,321 | 10/1987 | Horton | 166/350 |
| 4,762,180 | 8/1988 | Wybro et al. | 166/350 |
| 5,199,821 | 4/1993 | Huete et al. | 405/202 |
| 5,427,180 | 6/1995 | Leite et al. | 166/355 |

OTHER PUBLICATIONS

J. A. van Santen and K. de Werk, "On the Typical Qualities of SPAR Type Structures for Initial or Permanent Field Development." OTC 2716, Paper presented at the Eighth Annual Offshore Technology Conference, Houston, Tex., May 3–6, 1976, 14 pp.

EPO Search Report, mailed May 13, 1998.

*Primary Examiner*—Eileen D. Lillis
*Assistant Examiner*—Jong-Suk Lee

[57] ABSTRACT

A deepwater riser assembly is disclosed for a riser connecting subsea equipment to a surface wellhead. A buoyancy can assembly provides an open ended buoyancy can tube which surrounds the upper end of the riser and an upper seal which effectively closes the annulus between the riser and the buoyancy can tube. A load transfer connection in the buoyancy can assembly then connects the riser to buoyancy can tube. A pressure charging system communicates with the annulus between the riser and the buoyancy can tube below the upper seal. Injecting gas into this annulus then provides support to the riser.

11 Claims, 3 Drawing Sheets

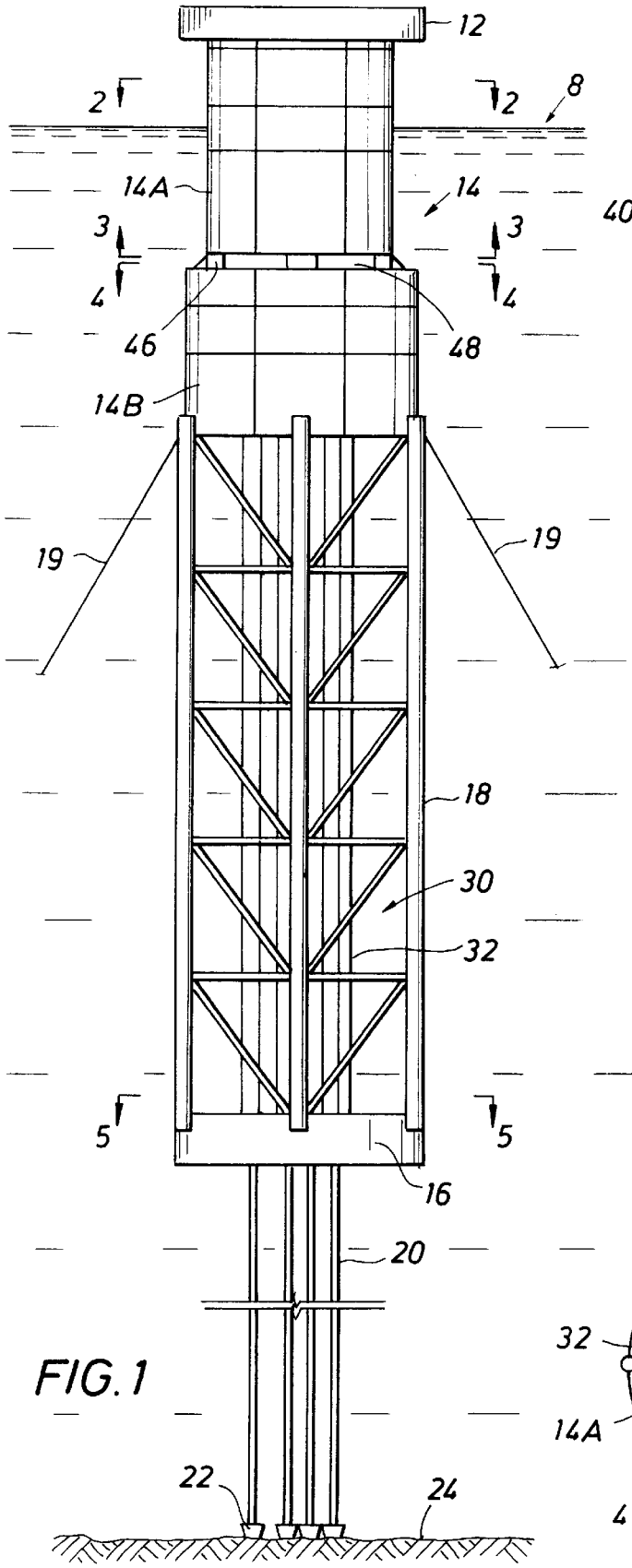
FIG. 1
FIG. 2
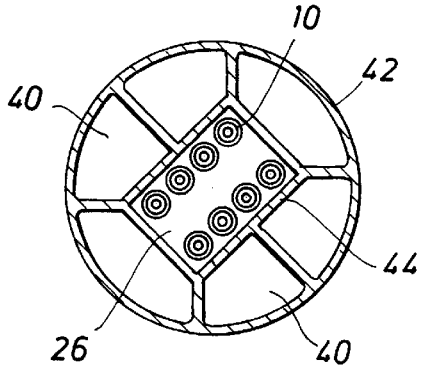
FIG. 3
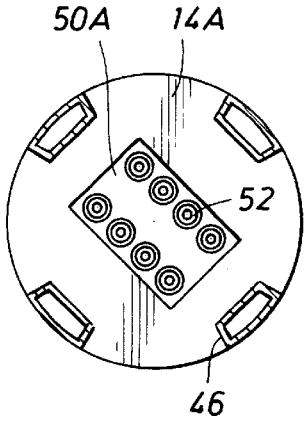
FIG. 4
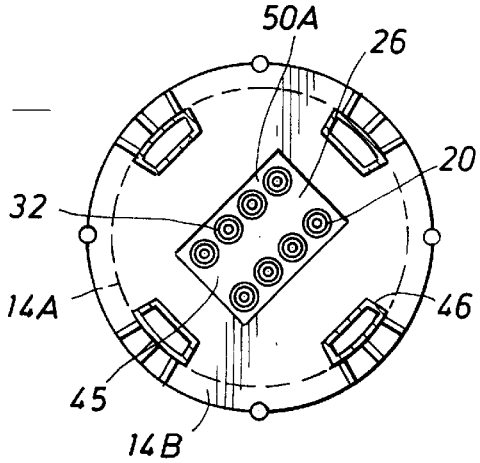

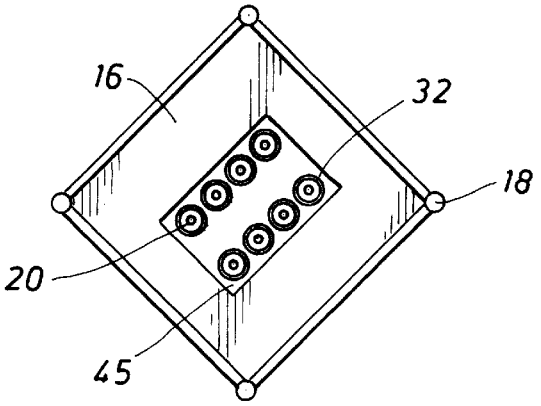
FIG. 5
FIG. 8
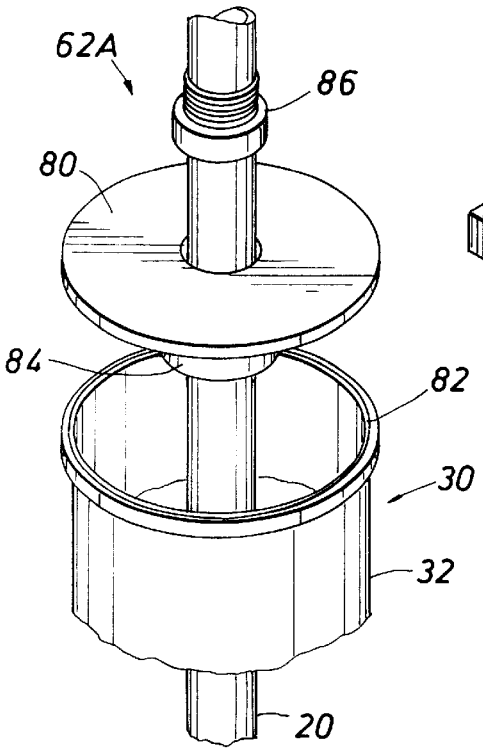
FIG. 10
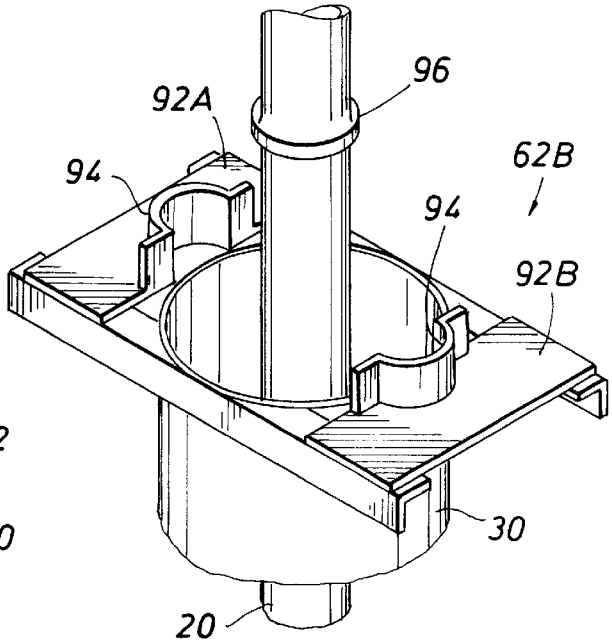
FIG. 9
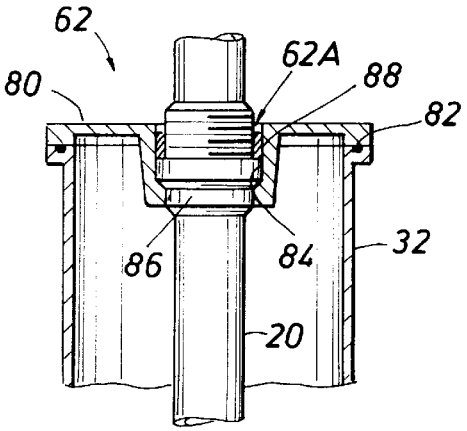
FIG. 11
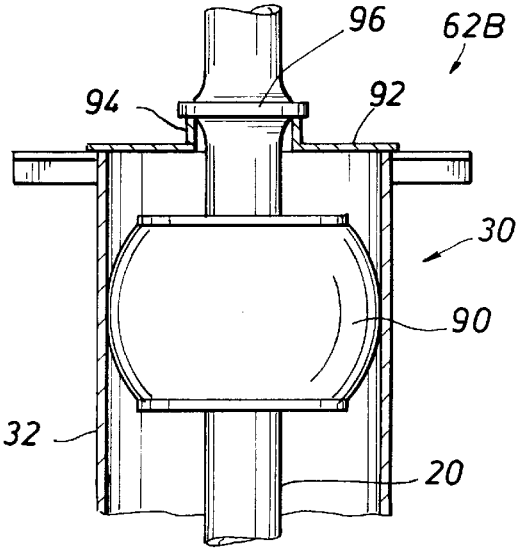

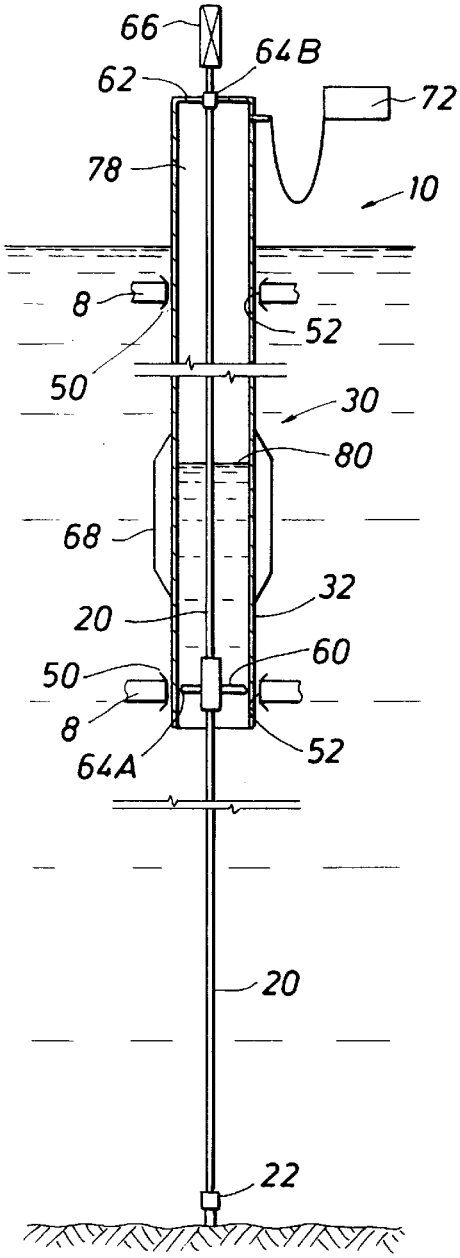
FIG. 6
FIG. 7
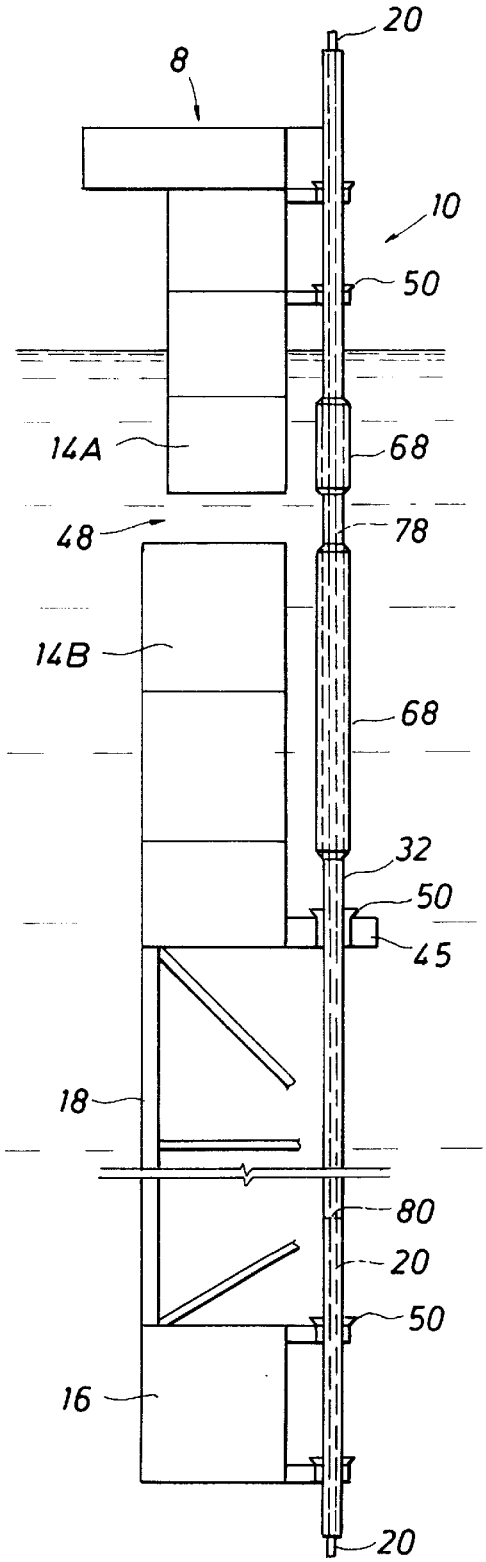

DEEPWATER RISER SYSTEM

This application claims the benefit of U.S. Provisional Application No. 60/034,465, filed Dec. 31, 1996, the entire disclosure of which is hereby incorporated by reference.

BACKGROUND OF THE INVENTION

The present invention relates to a method and apparatus for supporting risers in offshore applications. More particularly, the present invention relates to a method and system for supporting risers connecting subsea facilities such as wells or manifolds at the ocean floor to surface facilities such as Christmastrees or other production facilities provided on spar-type platforms or the like.

In traditional bottom founded platforms having fixed or rigid tower structures known as platform jackets, risers are provided lateral support with drive pipes or conductors installed through the length of the platform's structural framework. The conductors are large diameter tubular goods connected to the framework with conductor guides installed at frequent intervals along the length of the platform jacket. Although ultimately supporting production risers, the conductors also serve to guide the drill string, subsea valve placement, and other drilling and completion equipment prior to installing the production risers.

However, traditional bottom founded platforms have been taken to the logical depth limitations in the development of offshore oil and gas reserves. Economic and technical considerations suggest that alternatives to this traditional technology be used in the development of deepwater prospects.

Spar platforms provide an alternative which can support offshore developments in very deep water more economically than traditional fixed platforms. Spars platforms may be adapted to a number of configurations, including drilling platforms and drilling and production platforms. Further, spar platforms lend themselves well to a promising design premiss using minimal structures, e.g., spars with minimal completion and workover facilities or even minispars dedicated exclusively to production operations.

Unlike traditional fixed platforms, spar platforms and other deepwater concepts are designed to "give" in a controlled manner in response to dynamic environmental loads rather than to rigidly resist those forces. However, an attraction of the spar design is its characteristic resistance to heave and pitch motions. Nevertheless, spars are subject to sufficient motion at the ocean surface that this can be a significant design parameter for connected components such as risers which may be subject to significant relative motion with facilities on the spar platform. The risers are subject to buckling failure should a sufficient net compressive load develop in the riser. This would collapse the pathway within the riser necessary for drilling or production operations. Similarly, excess tension from uncompensated support can also damage the riser.

Thus, direct support from the spar platform to the riser requires a riser tensioning system with motion compensation capability to accommodate this relative motion. Whether active or passive, this requires major structural components with long life and moving parts in the harsh offshore environment.

Alternatively, the riser may be independently supported, e.g., by sufficient, submerged buoyancy modules to ensure a net tension (or at least to avoid an excess compressive load) to protect riser integrity throughout the range of riser motion. However, a riser to platform interface is still required that can accommodate relative motion between the riser and the spar. Yet this interface must not interject excessive bending moments and/or wear on the riser. This may be a particular problem with spars which have substantial lengths of vertically depending structure through which the risers must pass to connect topside facilities with equipment at the ocean floor.

This length of vertical structure raises other difficulties in just passing production risers or even the drill string or other equipment to the wells or subsea manifold.

An advantage of a deepwater riser system in accordance with the present invention is that it securely supports the riser and accommodates relative motion between the riser and platform while avoiding the need for complex motion compensating machinery and protects the riser from loads and wear at an interface.

A further advantage of the riser system of the present invention is that it provides lateral support to a substantial length of the production riser within the spar structure.

Yet another advantage of a riser system in accordance with the present invention is its availability for guiding a drill string, production riser, or other equipment run or installed through the vertical span of the spar platform.

SUMMARY OF THE INVENTION

The present invention is a deepwater riser assembly for a riser connecting subsea equipment to a surface wellhead. A buoyancy can assembly provides an open ended buoyancy can tube which surrounds the upper end of the riser and an upper seal which effectively closes the annulus between the riser and the buoyancy can tube. A load transfer connection in the buoyancy can assembly then connects the riser to buoyancy can tube. A pressure charging system communicates with the annulus between the riser and the buoyancy can tube below the upper seal. Injecting gas into this annulus then provides support to the riser.

BRIEF DESCRIPTION OF THE DRAWINGS

The brief description above, as well as further advantages of the present invention will be more fully appreciated by reference to the following detailed description of the illustrated embodiments which should be read in conjunction with the accompanying drawings in which:

FIG. 1 is a side elevational view of spar platform incorporating a riser system in accordance with the present invention;

FIG. 2 is a cross sectional view of the spar platform incorporating and riser system of FIG. 1, taken at line 2—2 of FIG.

FIG. 3 is a cross sectional view of the spar platform incorporating and riser system of FIG. 1, taken at line 3—3 of FIG. 1;

FIG. 4 is a cross sectional view of the spar platform incorporating and riser system of FIG. 1, taken at line 4—4 of FIG. 1;

FIG. 5 is a cross sectional view of the spar platform incorporating and riser system of FIG. 1, taken at line 5—5 of FIG. 1;

FIG. 6 is a schematically rendered cross sectional view of a riser system in accordance with the present invention;

FIG. 7 is a side elevational view of a riser system in accordance with the present invention;

FIG. 8 is an exploded perspective view of components of an upper seal in an embodiment of the present invention;

FIG. 9 is a cross sectional view of the assembled components of the upper seal configuration of FIG. 8;

FIG. 10 is a perspective view of an upper seal during riser installation in an embodiment of the present invention; and FIG. 11 is a cross sectional view of the assembled components of the upper seal configuration of FIG. 10.

A DETAILED DESCRIPTION OF ILLUSTRATIVE EMBODIMENTS

FIG. 1 illustrates a spar 8 having a deepwater riser system 10 in accordance with the present invention. In this illustration, spar 8 supports a deck 12 with a hull 14 having two spaced buoyancy sections 14A and 14B, of unequal diameter. A counterweight 16 is provided at the base of the spar and the counterweight is spaced from the buoyancy sections by a substantially open truss framework 18. Mooring lines 19 secure the spar platform over the well site.

Production risers 20 are incorporated into deepwater riser system 10. The production risers connect wells 22 or manifolds at seafloor 24 to surface completions at deck 12 to provide a flowline for producing hydrocarbons from subsea reservoirs. Here risers 20 extend through an interior or central moonpool 26 illustrated in the cross sectional views of FIGS. 2–5.

Spar platforms characteristically resist, but do not eliminate heave and pitch motions. Further, other dynamic response to environmental forces also contribute to relative motion between the riser 20 and the spar platform 8. Effective support for the risers which can accommodate this relative motion is critical because a net compressive load can buckle the riser and collapse the pathway within the riser necessary to conduct well fluids to the surface. Similarly, excess tension from uncompensated direct support can seriously damage the riser.

Returning to FIG. 1, the present invention provides a deepwater riser assembly for this support. A buoyancy can assembly 30 provides an open ended, large diameter buoyancy can tube 32 which surrounds the upper end of production riser 20 along its passage down through the moonpool and through the body of the spar. The smaller diameter production riser 20 emerges from the bottom of buoyancy can tube 32 below the base of the spar.

FIG. 2 is a cross section of spar 8 and deepwater riser system 10 taken through upper buoyancy section 14A. A plurality of buoyancy chambers 40 are defined between inner wall 42 and outer wall 44. A plurality of deepwater riser systems 10 are deployed in a riser array through moonpool 26. At this section, each riser system shows concentrically arranged production risers 20 and buoyancy can tubes 32.

The cross section of FIGS. 3 and 4 is taken below the water line at gap 48 between the base upper buoyancy section 14A and the top of lower buoyancy section 14B. FIG. 3 looks upward, at a riser guide structure 50A which is provided in this embodiment at the bottom of upper buoyant section 14A. The riser guide structure provides a guide tube 52 for each deepwater riser system 10, all interconnected in a structural framework connected to hull 14 of the spar. Further, in this embodiment, a significant density of structural conductor framework is provided at this level to tie conductor guide structures 50 for the entire riser array to the spar hull. Further, this can include a plate 45 across moonpool 26. FIG. 3 also shows a buoyant section spacing structure 46.

The cross section of FIG. 4 through gap 48 looks downward upon the top of lower buoyancy section 14B. In this embodiment, another riser guide structure 50B at gap 48 is provided a substantial density of conductor framing or with a plate 45 across moonpool 26. A third plate 45 is provided with buoyancy can tube guides 50C at the base of spar 8, here across moonpool 26 at counterweight 16. See FIG. 5.

The density of conductor framing and/or horizontal plates 45 serve to dampen heave of the spar. Further, the entrapped mass of water impinged by this horizontal structure is useful in otherwise tuning the dynamics of the spar, both in defining harmonics and inertia response. Yet this virtual mass is provided with minimal steel and without significantly increasing the buoyancy requirements of the spar.

Horizontal obstructions across the moonpool of a spar with spaced buoyancy section may also improve dynamic response by impeding the passage of dynamic wave pressures through gap 48, up moonpool 26. Other placement levels of the conductor guide framework, horizontal plates, or other horizontal impinging structure may be useful, whether across the moonpool, as outward projections from the spar, or even as a component of the relative sizes of the upper and lower buoyancy sections, 14A and 14B, respectively.

Further, vertical impinging surfaces such as the additional of vertical plates at various levels in open truss framework 18 may similarly enhance pitch dynamics for the spar with effective entrapped mass.

FIG. 6 is a cross sectional schematic of a deepwater riser system 10 constructed in accordance with the present invention. Within the spar structure, production risers 20 run concentrically within buoyancy can tubes 32. One or more centralizers 60 secure this positioning. Here centralizer 60 is secured at the lower edge of the buoyancy can tube and is provided with a load transfer connection 64A in the form of an elastomeric flexjoint which takes axial load, but passes some flexure deformation and thereby serves to protect riser 20 from extreme bending moments that would result from a fixed riser to spar connection at the base of spar 8. In this embodiment, the bottom of the buoyancy can tube is otherwise open to the sea.

The top of the buoyancy tube can, however, is provided with an upper seal 62 and a load transfer connection 64B. Riser 20 extends through seal 62 and presents a Christmas-tree 66 adjacent production facilities, not shown. These are connected with a flexible conduit, also not shown. In this embodiment, the upper load transfer connection assumes a less significant role than lower load transfer connection 64A which takes the load of the production riser therebeneath. By contrast, the upper load connection only takes the riser load through the length of the spar, and this is only necessary to augment the riser lateral support provided the production riser by the concentric buoyancy can tube surrounding the riser.

External buoyancy tanks 68, here hard tanks 68A are provided about the periphery of the relatively large diameter buoyancy can tube 32 and provide sufficient buoyancy to at least float an unloaded buoyancy can tube. In some applications it may be desirable for the hard tanks or other form of external buoyancy tanks 68 to provide some redundancy in overall riser support.

Additional, load bearing buoyancy is provided to buoyancy can assembly 30 by presence of a gas 70, e.g., air or nitrogen, in the annulus 78 between buoyancy can tube 32 and riser 20 beneath seal 62. A pressure charging system 72 provides this gas and drives water out the bottom of buoyancy can tube 32 to establish the load bearing buoyant force in the riser system.

Load transfer connections 64A and 64B provide a relatively fixed support from buoyancy can assembly 30 to riser 20. Relative motion between the spar 8 and the connected riser/buoyancy assembly is accommodated at riser guide structures 50 which include wear resistant bushings within riser guides tubes 52. The wear interface is between the guide tubes and the large diameter buoyancy can tubes and risers 20 are protected.

FIG. 7 is a side elevational view of a deepwater riser system 10 in a partially cross-sectioned spar 8. Like FIGS. 1–5, the illustrated spar has two buoyancy section 14A and 14B, of unequal diameter, separated by a gap 48. A counterweight 16 is provided at the base of the spar, spaced from the buoyancy sections by a substantially open truss framework 18.

The relatively small diameter riser 20 runs through the relatively large diameter buoyancy can tube 32. Hard tanks 68A are attached about the buoyancy can tube 32 and a gas injected into annulus 78 drives the water/gas interface 80 within buoyancy can tube 32 far down buoyancy can assembly 30.

Buoyancy can assembly 30 is slidingly received through a plurality of riser guides 50, some of which may be associated with horizontal plates 45.

Another optional feature of this embodiment is the absence of hard tanks 68 adjacent gap 48. Gap 48 in this spar design controls vortex induced vibration ("VIV") on the cylindrical buoyancy sections 14 by dividing the aspect ratio (diameter to height below the water line) with two, spaced buoyancy sections 14A and 14B having similar volumes and, e.g., a separation of about 10% of the diameter of the upper buoyancy section. Further, the gap reduces drag on the spar, regardless of the direction of current. Both these benefits requires the ability of current to pass through the spar at the gap. Therefore, reducing the outer diameter of a plurality of deepwater riser systems at this gap may facilitate these benefits.

Another benefit of gap 48 is that it allows passage of import and export steel catenary risers mounted exteriorly of lower buoyancy section 14B to the moonpool 26. This provides the benefits and convenience of hanging this risers exterior to the hull of the spar, but provide the protection of having these inside the moonpool near the water line where collision damage presents the greatest risk and provides a concentration of lines that facilitates efficient processing facilities. Note, for the sake of simplifying the drawings, the export and import risers and details of processing facilities have been omitted from the drawings.

In this illustration a substantial length of truss span 18 is broken away for the purposes of simplicity. However, it should be understood that spar 8 has a substantial overall length and may have many structural elements and other riser systems to be avoided in running production riser 20. Further, drilling, completion and workover operations need to pass equipment safely and efficiently through the length of the spar on the way to the ocean floor.

Supported by hard tanks 68 alone (without a pressure charged source of annular buoyancy), unsealed and open top buoyancy can tubes 32 can serve much like well conductors on traditional fixed platforms. Thus, the large diameter of the buoyancy can tube allows passage of equipment such as a guide funnel and compact mud mat in preparation for drilling, a drilling riser with an integrated tieback connector for drilling, surface casing with a connection pod, a compact subsea tree or other valve assemblies, a compact wireline lubricator for workover operations, etc. as well as the production riser and its tieback connector. Such other tools may be conventionally supported from a derrick, gantry crane, or the like throughout operations, as is the production riser itself during installation operations.

After the production riser is run (with centralizer 60 attached) and makes up with the well, seal 62 is established, the annulus is charged with gas and seawater is evacuated, and the load of the production riser is transferred to the buoyancy can assembly 30 as the deballasted assembly rises and load transfer connections at the top and bottom of the assembly engage.

FIGS. 8 and 9, and FIGS. 10 and 11 illustrate two alternative embodiments for creating seal 62 at the top of buoyancy can assembly 30. FIGS. 8 and 9 address a hanger type arrangement 62A in a "blown-up", expanded view and assembled view, respectively. Here the top of buoyancy can tube 32 is fitted with a housing 80 which and sealed at this connection with a gasket 82. A hanger receptacle 84 is built into the housing and a hanger spool 86 is provided on riser 20. A seal assembly 88 secures the pressure integrity of the hanger type seal 62A.

FIGS. 10 and 11 address a packer/spider type arrangement 62B in installation and assembled views, respectively. Here a single annular seal is provided by a low pressure, inflated packer 90. The structural load transfer connection is provided by a separate spider assembly 92 having collars 94 which receive a forged hang off flange 96. One advantage of this configuration is that packer 90 may take up a certain amount of movement within buoyancy can tubes 32 without compromising the seal, e.g, in response to angular motion passed through the lower load connection.

Although illustrated separately, the packer of FIG. 11 could be installed below the hanger assembly of FIGS. 8 and 9 to provide redundancy. Other modifications and combinations of load transfer and pressure seals may also be employed without departing from the spirit of the present invention.

Further, although disclosed in an illustrative embodiment deploying the present invention in a spar having a plurality of spaced apart buoyant sections with a gap therebetween, an interior moonpool, and a substantially open truss separating the buoyant sections from the counterweight; it is clear that the deepwater riser system of the present invention is not limited to this sort of spar embodiment. Such riser systems may be run exteriorly on spars without moonpools, may be deployed in "classic spars" in which the buoyant section, counterweight spacing structure and counterweight are all provided in the profile of a single elongated cylindrical hull, etc.

Other modifications, changes and substitutions are intended in the foregoing disclosure and in some instances some features of the invention will be employed without a corresponding use of other features. Accordingly, it is appropriate that the appended claims be construed broadly and in the manner consistent with the spirit and scope of the invention herein.

What is claimed is:

1. A deepwater riser assembly for use with a spar platform, comprising:

a riser connecting subsea equipment to a surface wellhead of the spar platform;

a buoyancy can assembly, comprising:

an open ended buoyancy can tube surrounding the upper end of the riser;

an upper seal effectively closing the annulus between the riser and the buoyancy can tube; and a load transfer connection between the buoyancy can tube and the riser;

a pressure charging system communicating with the annulus between the riser and the buoyancy can tube at a location below the upper seal;

a bottom centralizer connected to the riser at a level corresponding with the lower end of the buoyancy can tube and securing the alignment of the riser within the buoyancy can tube; and a plurality of buoyancy can guides mounted on the spar platform and slidingly receiving the exterior of the buoyancy can tubes to secure against relative transverse motion, but to permit relative axial motion.

2. A deepwater riser assembly in accordance with claim 1 wherein the upper seal comprises a low pressure packer.

3. A deepwater riser assembly in accordance with claim 1 wherein the upper seal comprises a hanger seal assembly which also comprises the load transfer connection.

4. A deepwater riser assembly in accordance with claim 1 further comprising a fixed buoyancy module connected to the buoyancy can tube and contributing buoyancy thereto.

5. A deepwater riser assembly in accordance with claim 4, wherein the fixed buoyancy module is a hard tank mounted about the circumference of the buoyancy can tube.

6. A deepwater riser assembly in accordance with claim 5, wherein the centralizer further comprises an elastomeric flexjoint.

7. A deepwater riser assembly in accordance with claim 6 further comprising a stress joint on the riser where the centralizer is attached.

8. A deepwater riser system for an offshore platform, the riser system comprising:

a riser running from a tieback connector near the seafloor to a surface wellhead;

a buoyancy can assembly, comprising:

an open ended buoyancy can tube surrounding the upper end of the riser;

a hard tank connected to the buoyancy can tube and contributing buoyancy thereto;

an upper seal effectively closing the annulus between the riser and the buoyancy can tube; and a load transfer connection between the buoyancy can tube and the riser;

a pressure charging system connected to the interior of the buoyancy can tube below the upper seal;

a bottom centralizer connected between the riser and the buoyancy can tube at a level corresponding with the lower end of the buoyancy can tube and securing the alignment of the riser within the buoyancy can tube, the bottom centralizer comprising an elastomeric flexjoint;

a stress joint in the riser at the connection of the riser and the buoyancy tube can;

a plurality of buoyancy can guides secured to the offshore platform and slidingly receiving the buoyancy can tube so as to resist lateral deflection but permit vertical relative motion.

9. A deepwater riser system in accordance with claim 8 wherein the upper seal comprises a low pressure packer.

10. A deepwater riser system in accordance with claim 8 wherein the upper seal comprises a multiple seal hanger seal assembly.

11. A deepwater riser system in accordance with claim 8, wherein the pressure charging system connected to the interior of the buoyancy can tube below the upper seal comprises a pressure controlled air supply.

* * * * *